US005842432A

United States Patent [19]

Wakasugi

[11] Patent Number: 5,842,432

[45] Date of Patent: Dec. 1, 1998

[54] THREAD CONSUMPTION DETECTING APPARATUS FOR A SEWING MACHINE

[75] Inventor: Kazuhisa Wakasugi, Obu, Japan

[73] Assignee: Aisin Seiki Kabushiki Kaisha, Kariya, Japan

[21] Appl. No.: 855,446

[22] Filed: May 13, 1997

[30] Foreign Application Priority Data

May 14, 1996 [JP] Japan ..... 8-118986

[51] Int. Cl.[6] ..... D05B 69/36; H01H 3/16

[52] U.S. Cl. ..... 112/278; 200/61.18

[58] Field of Search ..... 112/278, 273, 112/80.18; 200/61.13, 61.18

[56] References Cited

FOREIGN PATENT DOCUMENTS 57-12185 1/1982 Japan .
60-83697 5/1985 Japan .
7-663 1/1995 Japan .
7-47186 2/1995 Japan .

*Primary Examiner*—Peter Nerbun
*Attorney, Agent, or Firm*—Oblon, Spivak, McClelland, Maier & Neustadt, P.C.

[57] ABSTRACT

A thread consumption detecting apparatus includes an axial supporting shaft, a detector lever, a torsional spring, a proximity sensor, and a central processing unit (CPU). The detector lever includes an intermediate portion, a loop-shaped thread-contact end, and a base end. The intermediate portion is fitted idly around the supporting shaft so that the detector lever can swing. The thread-contact end is disposed so as to pass a thread outside the loop-shaped portion. The base end is detected by the proximity sensor. A swinging stroke of the detector lever is disposed so as to interfere with a thread-transfer-route variation range resulting from a fluctuation in tension of the thread. The torsional spring urges the detector lever in one swinging direction. The proximity sensor detects the base end on approach when the detector lever is swung by the tension of the thread. The CPU judges whether the thread is consumed or not in accordance with a signal output from the proximity sensor.

15 Claims, 5 Drawing Sheets

THREAD CONSUMPTION DETECTING APPARATUS FOR A SEWING MACHINE

BACKGROUND OF THE INVENTION

1. Field of the Invention

The present invention relates to a thread consumption detecting apparatus which is widely applicable to an industrial sewing machine, a domestic sewing machine, etc. In particular, the present invention is appropriate for a sewing machine which is provided with a thread changing apparatus, and which can carry out a sewing operation while selecting a thread out of a plurality of threads.

2. Description of the Related Art

Recently, sewing machines have been automated. Accordingly, it is generally a matter of course that the detection of thread consumption has also been carried out automatically.

Due to the wide spread use of microcomputers, many engineering techniques are available for detecting the consumption of thread. The engineering techniques can be classified into two major categories: namely; one of the two categories calculates a difference between a feeding amount of thread and a consumption amount thereof; and the other one of two categories is a sensor type detection technique which employs a switch, or the like, as a sensor. The latter, sensor type detection technique for detecting the consumption of thread is disclosed, for example, in Japanese Unexamined Patent Publication (KOKAI) No. 60-83,697 and Japanese Unexamined Patent Publication (KOKAI) No. 7-663. In most of the above listed patents, a predetermined tension is given to a thread so as to detect the consumption of the thread. Moreover, many of the patents employ a sensor whose contact is formed as a loop shape or a hook shape in order to guide a thread, thereby confining the thread in a predetermined transfer route.

When the conventional thread consumption detecting apparatuses are applied to a sewing machine which can select a thread out of a plurality of threads, one sensor is needed for every thread. In addition to a plurality of the thus provided sensors, one thread tensioner and one thread guide are also required for every thread. Thus, the conventional thread consumption detecting considerably complicate the construction around the thread transfer routes.

Further, it is troublesome for our change one thread to another thread even on sewing machines which are provided with a single needle, because the conventional thread consumption detecting apparatuses guide the thread so as to confine the thread in a predetermined transfer route. Hence, on sewing machines which are equipped with a plurality of needles, the thread-changing operation is, because one sensor should be provided for each of the threads.

Furthermore, the thread is subjected to a tension when it is taken up by a thread take-up lever. Accordingly, when the thread is guided by the conventional thread consumption detecting apparatuses, there arises the following fear: namely; although there remains the thread, the conventional thread consumption detecting apparatuses mistakenly detect that the thread has been consumed even when the thread is subjected to a slight tension.

In addition, it is difficult for the conventional thread consumption detecting apparatuses to judge whether the thread is simply slackened or not. For example, let us consider a case where a central processing unit (i.e., CPU) judges the outputs from the sensor, and where it periodically judges whether the thread is consumed or not. The CPU mistakenly determines that the thread has been consumed when it continuously judges that the thread is slackened for a period of a threshold time. Fundamentally, the engineering techniques (e.g., sensing the thread consumption by giving a mechanical tension to the thread) are inferior in terms of reliability, because they are characterized in that the object to be sensed is a thread.

SUMMARY OF THE INVENTION

The present invention has been developed in view of the problems associated with the aforementioned conventional engineering techniques. It is therefore an object of the present invention to provide a thread consumption detecting apparatus which can detect the consumption of a thread without forcibly giving a tension to the thread and without confinedly guiding the thread. In particular, it is a further object of the present invention to make such a thread consumption detecting apparatus effectively applicable to a sewing machine which can select a plurality of threads, and which is provided with a plurality of needles.

In order to achieve the aforementioned objectives, the inventor of the present invention investigated extensively into the problems associated with the conventional thread consumption detecting apparatuses. As a result, the inventor recognized that the problems could be solved by the following arrangements. For instance, a detector lever is prepared so as to include a loop-shaped portion and an intermediate portion which can swing the detector lever per se about itself; a thread is made to transfer outside the detector lever; the detector lever is disposed so that a swinging stroke of the loop-shaped portion interferes with a thread-transfer-route variation range which results from a fluctuation in tension of the thread; and a predetermined urging force is given to the detector lever.

A thread consumption detecting apparatus according to the present invention carries out the aforementioned objects, and comprises:

- an axial supporting shaft disposed on an arm, the axial supporting shaft extending perpendicularly to a direction of a transfer route of a thread, the transfer route traveling from a thread guide to an eye of a needle;
- a detector lever including an intermediate portion, a loop-shaped thread-contact end, and a base end, the intermediate portion fitted idly around the supporting shaft, the loop-shaped thread-contact end extending from the intermediate portion in one direction, the base end extending from the intermediate portion in another direction, the detector lever disposed so that the thread passes outside the loop-shaped thread-contact end, the detector lever being capable of swinging about the intermediate portion so that a swinging stroke thereof interferes with a thread-transfer-route variation range resulting from a fluctuation in tension of the thread;
- detecting means for detecting the base end of the detector lever on approach when the detector lever is swung by the tension of the thread, and for outputting a detection signal;
- urging means for urging the detector lever in one swinging direction so that the base end of the detector lever approaches said detecting means; and
- judging means for judging whether the thread is consumed or not in accordance with the detection signal output from the detecting means.

The thus arranged thread consumption detecting apparatus according to the present invention operates as follows. In a routine operation, the thread is repeatedly subjected to a take-up force exerted by a thread take-up lever, etc., during a sewing operation, and thereby the thread varies its transfer route within a predetermined range. Specifically, the thread is slackened when the needle is positioned at the bottom dead center. The thread is subjected to a tension when the needle is positioned at the top dead center. As a result, the thread varies its transfer route repeatedly. The detector lever swings between a needle side of the varying thread-transfer route and a thread-guide side (or upper side) thereof. In this instance, a swinging stroke of the detector lever interferes with a thread-transfer-route variation range. As a result, when a tension is given to the thread, the thread presses the loop-shaped thread-contact end of the detector lever which exerts an urging force through the urging means within the swinging stroke. When the detector lever thus swings, the detecting means detects the base end of the detector lever. The judging means judges whether the thread is consumed or not in accordance with the detection signal which is output from the detecting means. In this instance, the detection signal is a signal which varies intermittently depending on a fluctuation in the tension of the thread during a sewing operation.

In the present thread consumption detecting apparatus, the thread consumption can always be stably detected, because the object to be detected is the natural fluctuation in the tension of the thread. Hence, the thread consumption detection, which is established by the present thread consumption detecting apparatus, is superb in terms of reliability.

As having described so far, the present thread consumption detecting apparatus can detect the consumption of the thread without confining the thread in a predetermined transfer route. Moreover, the present thread consumption detecting apparatus can reduce the burden of the complicated thread changing operation on a sewing machine which can be carried out a sewing operation while selecting a thread out of a plurality of threads. In addition, the present thread consumption detecting apparatus can remarkably improve the accuracy of the thread consumption detection.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
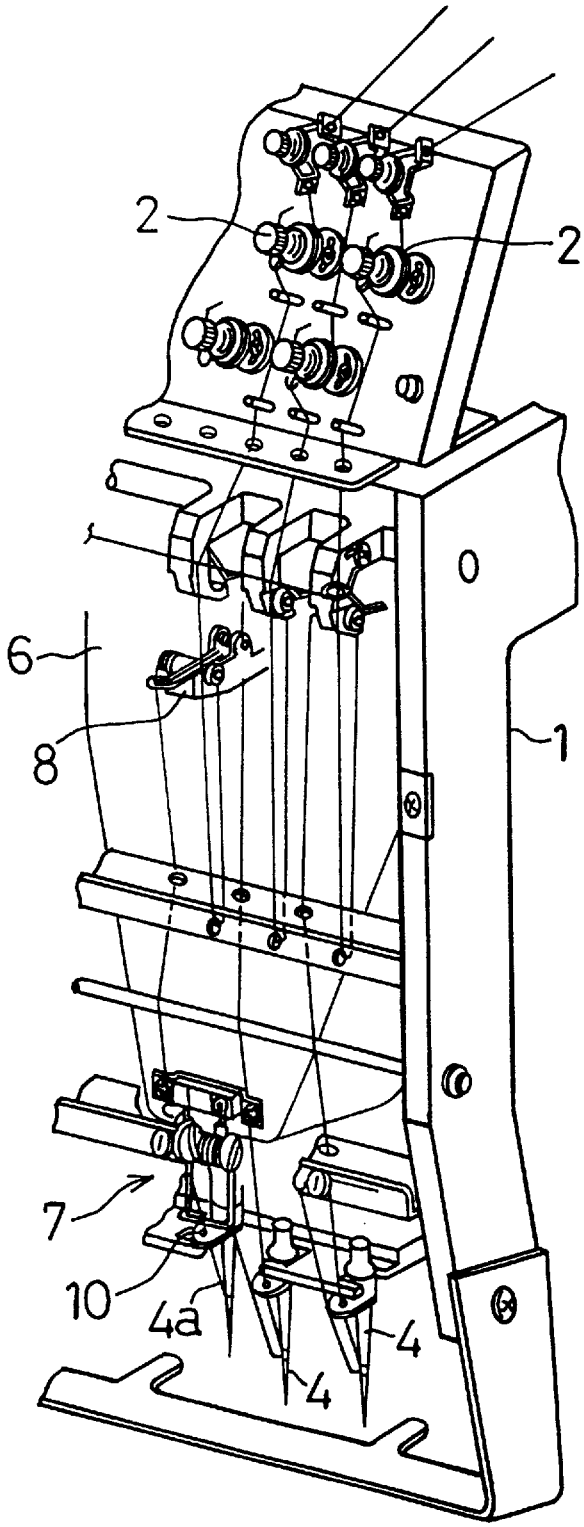
FIG. 1 is a rough perspective view of a sewing machine which can carry out a sewing operation while selecting a thread out of a plurality of threads, and which is provided with a preferred embodiment of a thread consumption detecting apparatus according to the present invention.

Having generally described the present invention, a further understanding can be obtained by reference to the specific preferred embodiments which are provided herein for the purpose of illustration only and not intended to limit the scope of the appended claims.

When a thread changing apparatus of the sewing machine, which is equipped with the thread consumption detecting apparatus according to the present invention, selects a thread out of a plurality of threads, the thread consumption detecting apparatus positions the detector lever in a transfer route of the selected thread so that the consumption of the selected thread can be detected. Consequently, even when the sewing machine, which can carry out a sewing operation while selecting a thread out of a plurality of threads, is provided with the single thread consumption detecting apparatus only, the single thread consumption detecting apparatus can detect the consumption of all of the threads.

As for the urging means, it is possible to employ an elastic member, such as a torsional spring, rubber, and the like. By adjusting a spring constant, an elastic constant, and the like, of the elastic member, it is possible for the detecting means to detect the base end of the detector lever on approach in accordance with the tension of an arbitrary magnitude. Note that the arbitrary magnitude ranges from an initial tension, at which the tension arises in the thread, to a maximum tension of the thread in the tension fluctuation during a sewing operation. When the tension is in a phase of the initial tension, and when the judging means judges that the tension arises in the thread, it is possible to eliminate the failure detection in which the thread is mistakenly judged to be consumed but it is actually slackened as a whole. Note that the situation does not imply that the thread is consumed. On the other hand, when the detecting means detects the base end of the detector lever on approach in accordance with the maximum tension of the thread, it is possible to eliminate the failure detection in which the thread is mistakenly judged to be consumed but it is actually tensely pulled.

In the thread consumption detecting apparatus according to the present invention, the judging means can be arranged so that it judges whether the thread is consumed or not in accordance with a detection signal which is intermittently output from the detecting means in accordance with a tension fluctuation arising in the thread during a sewing operation. Thus, the detecting means detects the natural fluctuation of the tension in the thread during a sewing operation. Accordingly, when the thread is actually consumed, the judging means can judge the consumption of the thread in a relatively shorter period of time than the conventional apparatuses which mechanically give a tension to the thread. All in all, a stable thread consumption detection method can be realized by the present thread consumption detecting apparatus, and its reliability is prominently high.

As for the detecting means, it is possible to employ a proximity sensor, such as an optical proximity sensor, an overcurrent proximity switch, and the like. When an overcurrent proximity switch is employed as the detecting means, it is necessary to at least use metal to form the base end of the detector lever.

Depending on the swinging directions of the detector lever, swinging directions which result from the directions of an urging force exerted to the detector lever by the urging means, the following preferred arrangements are available for the proximity sensor. For example, the proximity sensor can be disposed so that the detector lever is urged by an urging force of the urging means in such a direction that the base end thereof always approaches the proximity sensor;

and it can be disposed so that the detector lever is urged by an urging force of the urging means in such a direction that the base end thereof is always separated from the proximity sensor. Note that, in these preferred arrangements, the tension of the thread is applied to the loop-shaped thread-contact end of the detector lever in directions reverse to each other.

A preferred embodiment of the thread consumption detecting apparatus according to the present invention will be hereinafter described with reference to FIGS. 1 through 5. Note that the preferred embodiment is arranged so as to make a thread consumption detector to be installed to a sewing machine which can carry out a sewing operation while selecting a thread out of a plurality of threads.

Figure 2:
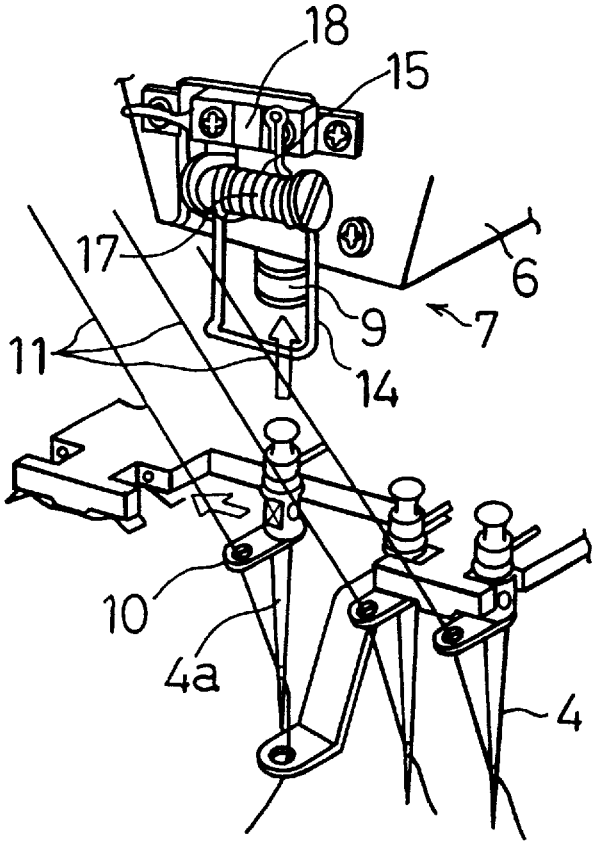
FIG. 2 is an enlarged perspective view for illustrating how a thread changing operation is carried out on the sewing machine.
Figure 3:
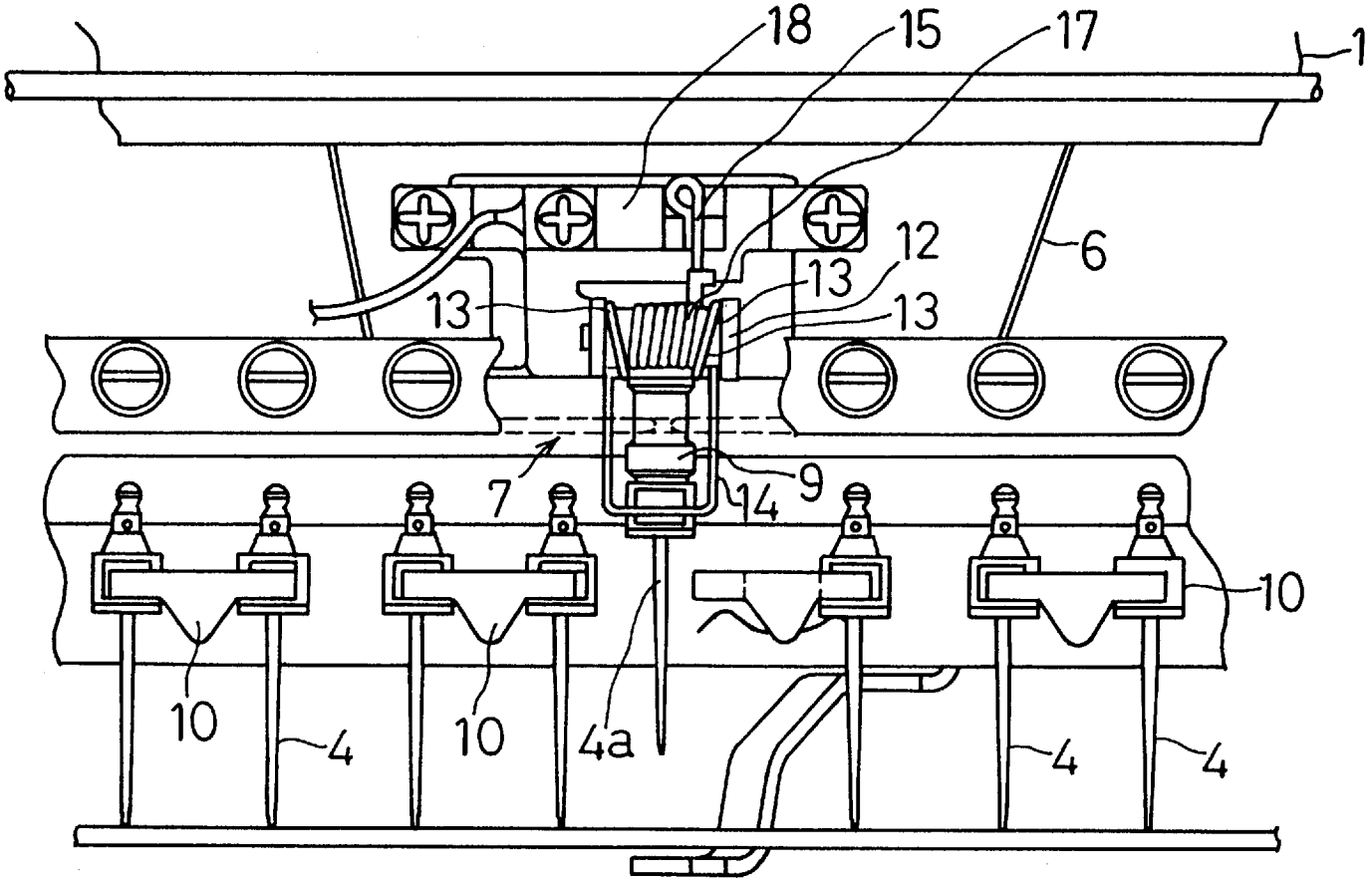
FIG. 3 is a front view which partially enlarges the sewing machine illustrated in FIG. 1.

In FIG. 1, a frame 1 is designated at 1. The frame 1 is provided with thread tensioners 2 and a thread guide 3 (best shown in FIGS. 4 and 5). The thread tensioners 2 and thread guide 3 can cope with a plurality of threads, and they are installed along a plurality of thread transfer routes. Further, on a lower side of the frame 1, a plurality of needles 4*a*, 4, 4 . . . are disposed so as to deal with a plurality of thread. Note that, in the drawing, the needle 4*a* is selected by a thread changing apparatus 6 which is disposed in rear of the frame 1. The thread changing apparatus 6 is provided with a thread consumption detector 7 (i.e., the preferred embodiment of the thread consumption detecting apparatus according to the present invention) and a thread take-up lever 8. As illustrated in FIG. 2, the thread changing apparatus 6 slides in from the rear of the frame 1 so that the needle 4*a* can be held in a needle bar 9. Thus, a thread can be selected out of a plurality of threads. As illustrated in FIG. 3, needles 4, 4 . . . are held in sockets 10 in a set of two. The thread consumption detector 7 is positioned between the sockets 10 when a sewing operation is carried out.

Figure 4:
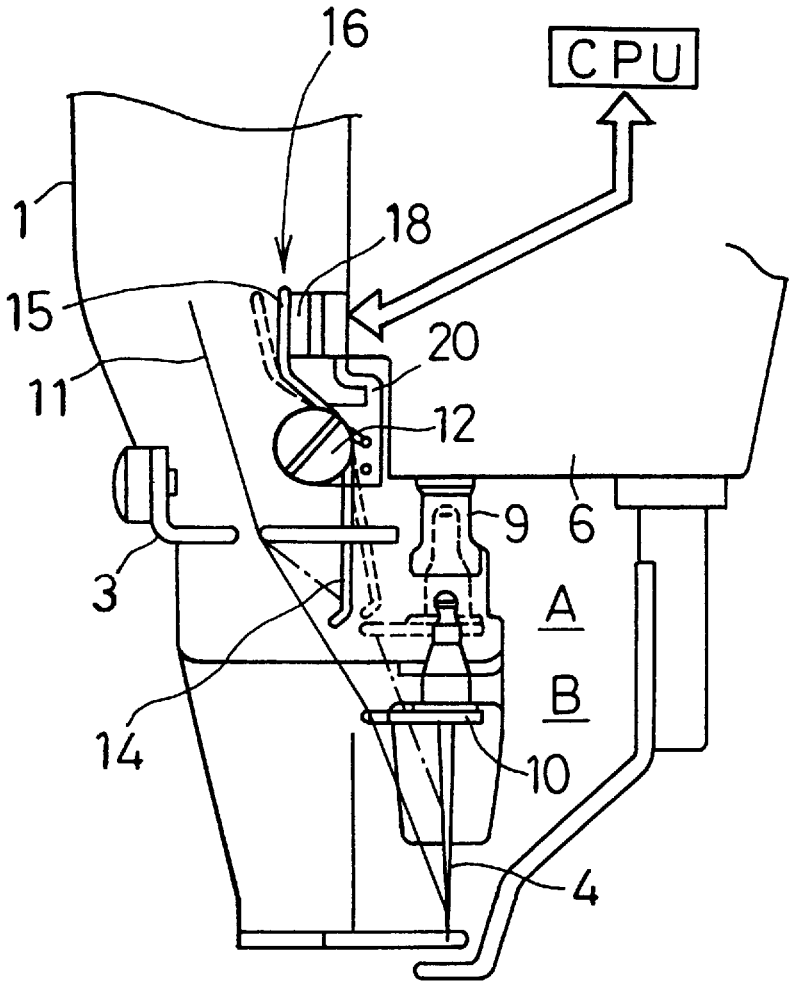
FIG. 4 is a side view which illustrates a major portion of the preferred embodiment of the present thread consumption detecting apparatus.
Figure 5:
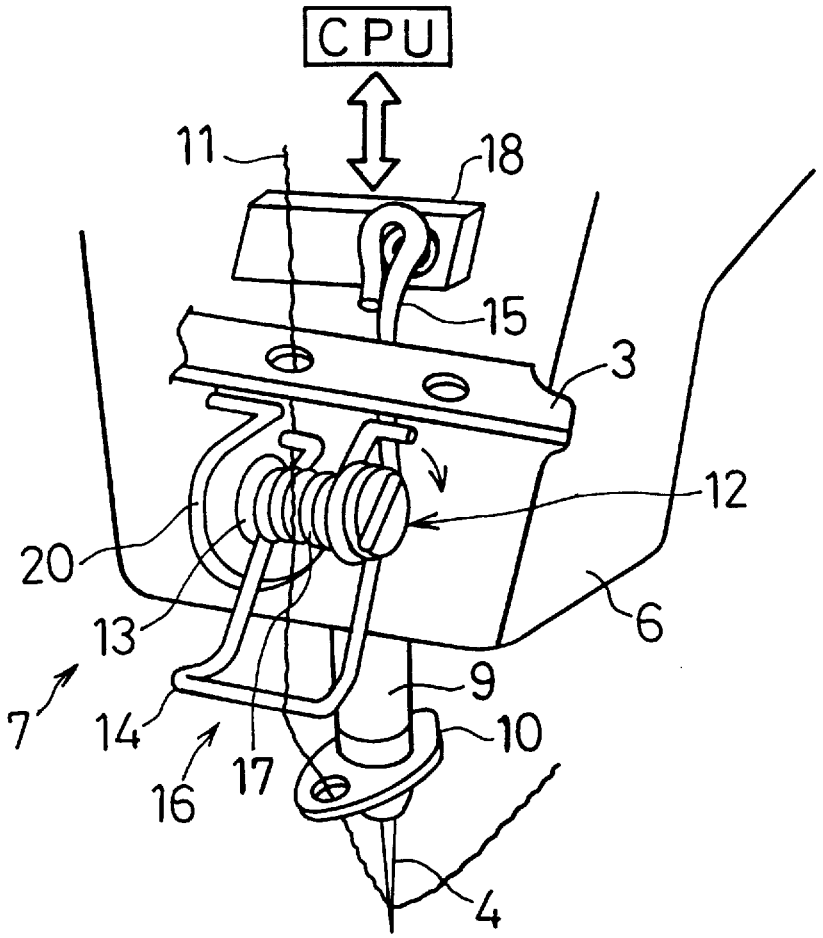
FIG. 5 is a perspective view which is viewed diagonally in front of the preferred embodiment of the present thread consumption detecting apparatus illustrated in FIG. 4.

FIGS. 4 and 5 illustrate the thread consumption detector 7 which is installed on the thread changing apparatus 6. As illustrated in FIGS. 4 and 5, the thread consumption detector 7 includes an axial supporting shaft 12, a detector lever 16, a torsional spring 17 (best shown in FIG. 5), and an overcurrent proximity switch 18. The axial supporting shaft 12 is fixed to a bracket 20 so that it is disposed perpendicular to a transfer route of a thread 11 which extends between the thread take-up lever 8 and the needle 4 by way of the thread guide 3. The detector lever 16 includes an intermediate portion 13 (best shown in FIG. 5), a rectangularly-loop-shaped thread-contact end 14, and a base end 15. As illustrated in FIG. 5, the intermediate portion 13 is wound torsionally around the supporting shaft 12. The rectangularly-loop-shaped thread-contact end 14 extends from the intermediate portion 13 in one direction. The base end 15 extends from the intermediate portion 13 in another direction. As illustrated in FIG. 5, the torsional spring 17 is fitted around the supporting shaft 12 so as to urge the detector lever 16 about the supporting shaft 12 in a clockwise direction in the drawing. The overcurrent proximity switch 18 can detect the base end 15 of the thus urged detector lever 16 on approach. The detector lever 16 is formed of a linear steel material. The linear steel material is bent at an end in a rectangular shape by one turn so as to make the thread-contact end 14, and is further bent at another end in a hook shape by one turn to make the base end 15. The linear steel material is further wound at its middle portion by one turn so as to make the intermediate portion 13 which is fitted idly around the supporting shaft 12.

As can be seen from FIG. 4, in the thread consumption detector 7, the detector lever 16 is disposed so as to pass the thread 11 outside the loop-shaped portion of the thread-contact end 14. Moreover, the detector lever 16 can swing about the intermediate portion 13. In addition, a swinging stroke of the detector lever 16 (i.e., an angular range between the solid lines and the dotted lines in the drawing) interferes with a thread-transfer-route variation range (i.e., an area between the solid lines and the alternate long and short dash lines in the drawing). Note that the thread-transfer-route variation range results from a fluctuation in the tension of the thread 11.

In the thus constructed thread changing apparatus 6, the needle 4 is substantially at the bottom dead center when the thread take-up lever 8 (shown in FIG. 1) descends. Whilst, the needle 4 is substantially at the top dead center when the thread take-up lever 8 ascends. The needle 4 ascends as the thread take-up lever 8 ascends. At a thread changing point "B" illustrated by the solid lines in FIG. 4, the thread 11 is stretched so that it connects linearly between an eye of the needle 4 and a thread-letting-through of the thread guide 3 by way of a thread-letting-through hole of the sockets 10, and is thereby subjected to a tension. At the top dead center "A" illustrated by the dotted lines in the drawing, the thread 11 is kept in the aforementioned state continuously. Thus, it is possible to distinguish the state of the thread 11 over that of the thread 11 when the needle 4 is positioned at the bottom dead center. Namely, when the needle 4 is positioned at the bottom dead center, the thread 11 is put into a slackened state so that it connects like a curve between the eye of the needle 4 and the thread-letting-through hole of the thread guide 3 by way of the thread-letting-through hole of the sockets 10.

In the thread consumption detector 7, the tension of the thread 11 results in a force which presses the loop-shaped thread-contact end 14 of the detector lever 16. The pressing force overcomes the urging force of the torsional spring 17. Note that the tension of the thread 11 never overcomes the urging force of the torsional spring 17 when the needle 4 is positioned at the bottom dead center, or when the thread 11 is consumed and put into the slackened state. Accordingly, as illustrated in FIG. 4, the detector lever 16 swings about the axial supporting shaft 12 in the counterclockwise direction in the drawing. Then, the base end 15 of the detector lever 16, which has been positioned in proximity to the overcurrent proximity switch 18 by the urging force of the torsional spring 17, is separated from the overcurrent proximity switch 18. For example, the variation in the signal detected by the overcurrent proximity switch 18 can be picked up by judging means (e.g., a central processing unit (CPU) of a sewing machine) as an amplitude variation. As a result, the overcurrent proximity switch 18 constantly detects a pulsating electric signal when the thread 11, or the like, is under ordinary condition where the needle 4, or the like, moves vertically in a sewing operation. In the preferred embodiment of the present thread consumption detecting apparatus, as far as the thread 11, or the like, is under ordinary condition, the overcurrent proximity switch 18 always detects the signal which results from a fluctuation in the tension of the thread 11, or the like. All in all, it is possible to judge that the thread 11, or the like, is put into abnormal condition when the signal is not detected for a predetermined period of time.

In the preferred embodiment of the present thread consumption detecting apparatus, a central processing unit (i.e., CPU) of a sewing machine can be used as the judging means. Hence, by always monitoring the signal, which is output from the overcurrent proximity switch 18, with the CPU, it is possible to readily judge whether the thread 11, or the like, is consumed or not.

As having described so far, in the thread consumption detector 7, the thread 11, or the like, is designed to pass outside the loop-shaped portion of the thread-contact end 14 of the detector lever 16. Consequently, the thread 11, or the like, hardly interferes with the thread changing apparatus 6 when the thread changing apparatus 6 slides in a thread changing operation. As a result, the thus arranged single and independent thread consumption detector 7 can detect the consumption of all of the threads for all of the needles in a sewing machine, which can carry out a sewing operation while selecting a thread out of a plurality of threads. All in all, the thread consumption detector 7 can realize a remarkable cost reduction as well as a simplified thread changing operation.

Having now fully described the present invention, it will be apparent to one of ordinary skill in the art that many changes and modifications can be made thereto without departing from the spirit or scope of the present invention as set forth herein including the appended claims.

What is claimed is:

1. A thread consumption detecting apparatus, comprising:

an axial supporting shaft disposed on an arm, the axial supporting shaft extending perpendicularly to a direction of a transfer route of a thread, the transfer route traveling from a thread guide to an eye of a needle;

a detector lever including an intermediate portion, a loop-shaped thread-contact end, and a base end, the intermediate portion fitted idly around said supporting shaft, the loop-shaped thread-contact end extending from the intermediate portion in one direction, the base end extending from the intermediate portion in another direction, the detector lever disposed so that the thread passes outside the loop-shaped thread-contact end, the detector lever being capable of swinging about the intermediate portion so that a swinging stroke thereof interferes with a thread-transfer-route variation range resulting from a fluctuation in tension of the thread;

detecting means for detecting the base end of said detector lever on approach when said detector lever is swung by the tension of the thread, and for outputting a detection signal;

urging means for urging said detector lever in one swinging direction so that the base end of said detector lever approaches said detecting means; and judging means for judging whether the thread is consumed or not in accordance with the detection signal output from said detecting means.

2. The thread consumption detecting apparatus according to claim 1, wherein said urging means is adjusted so as to enable said detecting means to detect the tension of an arbitrary magnitude, the arbitrary magnitude ranging from an initial tension, at which the tension arises in the thread, to a maximum tension of the thread.

3. The thread consumption detecting apparatus according to claim 1 being applicable to a thread changing apparatus of a sewing machine which can carry out a sewing operation while selecting a thread out of a plurality of threads.

4. The thread consumption detecting apparatus according to claim 3, wherein said sewing machine includes a central processing unit which shares a function of said judging means.

5. The thread consumption detecting apparatus according to claim 1, wherein said judging means judges whether the thread is consumed or not in accordance with a detection signal which is intermittently output from said detecting means in accordance with a tension fluctuation arising in the thread during a sewing operation.

6. The thread consumption detecting apparatus according to claim 1, wherein said urging means is an elastic member whose elastic constant is adjusted so as to enable said detecting means to detect the base end of said detector lever on approach in accordance with a tension fluctuation arising in the thread during a sewing operation.

7. The thread consumption detecting apparatus according to claim 6, wherein said elastic member is a torsional spring.

8. The thread consumption detecting apparatus according to claim 1, wherein said detecting means is a proximity sensor.

9. The thread consumption detecting apparatus according to claim 8, wherein said detector lever is urged by an urging force of said urging means in such a direction that the base end thereof always approaches to said proximity sensor.

10. The thread consumption detecting apparatus according to claim 8, wherein said proximity sensor is an overcurrent proximity switch.

11. The thread consumption detecting apparatus according to claim 10, wherein at least the base end of said detector lever is formed of metal.

12. The thread consumption detecting apparatus according to claim 1, wherein said detector lever is formed of a linear metallic material, which is bent at an end in a rectangular shape by one turn so as to make the thread-contact end of said detector lever, which is bent at another end in a hook shape by one turn to make the base end thereof, and which is wound at a middle portion by one turn so as to make the intermediate portion thereof.

13. The thread consumption detecting apparatus according to claim 1, wherein said detector lever is swung by the tension of the thread when the tension of the thread overcomes an urging force exerted by said urging means to said detector lever.

14. The thread consumption detecting apparatus according to claim 1, wherein said detecting means always detects a signal which results from the fluctuation in the tension of the thread.

15. The thread consumption detecting apparatus according to claim 14, wherein said judging means always monitors the signal detected by said detecting means, thereby judging that the thread is consumed when it is free from receiving the signal for a predetermined period of time.

* * * * *